US008079808B2

(12) United States Patent
Sconfietti

(10) Patent No.: US 8,079,808 B2
(45) Date of Patent: Dec. 20, 2011

(54) GEARED INLET GUIDE VANE FOR A CENTRIFUGAL COMPRESSOR

(75) Inventor: Renato A. Sconfietti, Melzo (IT)

(73) Assignee: Ingersoll-Rand Company, Montvale, NJ (US)

( * ) Notice: Subject to any disclaimer, the term of this patent is extended or adjusted under 35 U.S.C. 154(b) by 672 days.

(21) Appl. No.: 11/617,252

(22) Filed: Dec. 28, 2006

(65) Prior Publication Data

US 2007/0154302 A1 Jul. 5, 2007

Related U.S. Application Data

(60) Provisional application No. 60/755,252, filed on Dec. 30, 2005.

(51) Int. Cl.
*F04D 17/12* (2006.01)

(52) U.S. Cl. ..... 415/179; 415/169.2; 415/206; 415/199.1; 415/162

(58) Field of Classification Search ..... 415/178, 415/179, 205, 206, 161, 169.2, 199.1
See application file for complete search history.

(56) References Cited

U.S. PATENT DOCUMENTS

| | | | | |
|---|---|---|---|---|
| 3,014,639 | A * | 12/1961 | Boli | 417/243 |
| 3,362,625 | A | 1/1968 | Endress | |
| 3,741,676 | A * | 6/1973 | Silvern et al. | 415/58.1 |
| 4,087,197 | A * | 5/1978 | Haugen | 415/66 |
| 4,125,345 | A * | 11/1978 | Yoshinaga et al. | 417/243 |
| 4,527,949 | A * | 7/1985 | Kirtland | 415/150 |
| 4,616,483 | A * | 10/1986 | Leonard | 62/115 |
| 4,969,798 | A * | 11/1990 | Sakai et al. | 415/157 |
| 5,146,764 | A * | 9/1992 | Bauman et al. | 62/228.5 |
| 5,553,997 | A * | 9/1996 | Goshaw et al. | 415/17 |
| 5,807,071 | A * | 9/1998 | Brasz et al. | 415/150 |
| 5,947,680 | A * | 9/1999 | Harada et al. | 415/17 |
| 6,039,534 | A * | 3/2000 | Stoner et al. | 415/162 |
| 6,244,058 | B1 * | 6/2001 | Duga et al. | 62/177 |
| 2004/0055740 | A1 | 3/2004 | Meshenky et al. | |
| 2009/0196745 | A1 | 8/2009 | Sugitani | |

FOREIGN PATENT DOCUMENTS

| | | |
|---|---|---|
| EP | 0331902 | 9/1989 |
| GB | 674689 | 6/1952 |
| WO | 02095237 | 11/2002 |
| WO | 2008124758 A1 | 10/2008 |

* cited by examiner

*Primary Examiner* — Ninh H Nguyen
(74) *Attorney, Agent, or Firm* — Michael Best & Friedrich LLP

(57) ABSTRACT

A compressor assembly has a fluid inlet positioned to facilitate the passage of a fluid. The compressor assembly includes a compressor housing defining a compressor inlet and an impeller rotatably supported at least partially within the compressor housing. The impeller includes an inducer portion. A fluid treatment member is disposed adjacent the compressor housing and between the compressor inlet and the inducer portion and an inlet vane assembly I disposed adjacent the compressor inlet and includes a plurality of vanes. Each of the vanes is movable between a first position and a second position to control the quantity of fluid that passes to the impeller.

21 Claims, 9 Drawing Sheets

GEARED INLET GUIDE VANE FOR A CENTRIFUGAL COMPRESSOR

RELATED APPLICATION DATA

This application claims benefit under 35 U.S.C. Section 119(e) of U.S. Provisional Application No. 60/755,252 filed Dec. 30, 2005, which is fully incorporated herein by reference.

BACKGROUND

The present invention relates to an inlet guide vane device to control the flow and the pressure ratio of a centrifugal compressor or centrifugal compressor stage. More particularly, the present invention relates to an inlet guide vane that is adjustable to vary flow through the compressor or compressor stage.

Compressors, and more particularly centrifugal compressors, operate across a wide range of operating parameters. Variation of some of these parameters may produce undesirable efficiency and capacity variations. In addition, multistage compressors may operate under circumstances in which one or more of the stages operate at an undesirable pressure ratio or discharge too much or too little flow.

SUMMARY

In one construction, the invention provides a compressor assembly having a fluid inlet positioned to facilitate the passage of a fluid. The compressor assembly includes a compressor housing defining a compressor inlet and an impeller rotatably supported at least partially within the compressor housing. The impeller includes an inducer portion. A fluid treatment member is disposed adjacent the compressor housing and between the compressor inlet and the inducer portion and an inlet vane assembly I disposed adjacent the compressor inlet and includes a plurality of vanes. Each of the vanes is movable between a first position and a second position to control the quantity of fluid that passes to the impeller.

In another construction, the invention provides a compressor assembly that includes a first stage including a first inlet, a first impeller rotatable about a first axis that defines a first axial direction, and a first cooler. At least a portion of the first cooler is disposed axially between the first impeller and the first inlet. The first stage also includes a first inlet vane assembly positioned adjacent the first impeller and movable between a first position and a second position. A second stage includes a second inlet, a second impeller rotatable about a second axis that defines a second axial direction, and a second cooler. At least a portion of the second cooler is disposed axially between the second impeller and the second inlet. The second stage also includes a second inlet vane assembly positioned adjacent the second impeller and movable between a first position and a second position. The second stage is coupled to the first stage such that a flow of fluid enters the first inlet, flows through the first stage, and enters the second stage.

In yet another construction, the invention provides a compressor assembly that includes a compressor housing defining an inlet adjacent a first end and an impeller portion adjacent a second end. A fluid treatment member is at least partially supported by the compressor housing and an inlet vane assembly is positioned adjacent the second end and includes a plurality of vanes arranged to define a flow area. Each of the vanes is movable between a first position and a second position to vary the flow area. An impeller is rotatably supported adjacent the impeller portion and is operable to draw a flow of fluid through the inlet and the flow area and direct the flow of fluid to the fluid treatment member.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
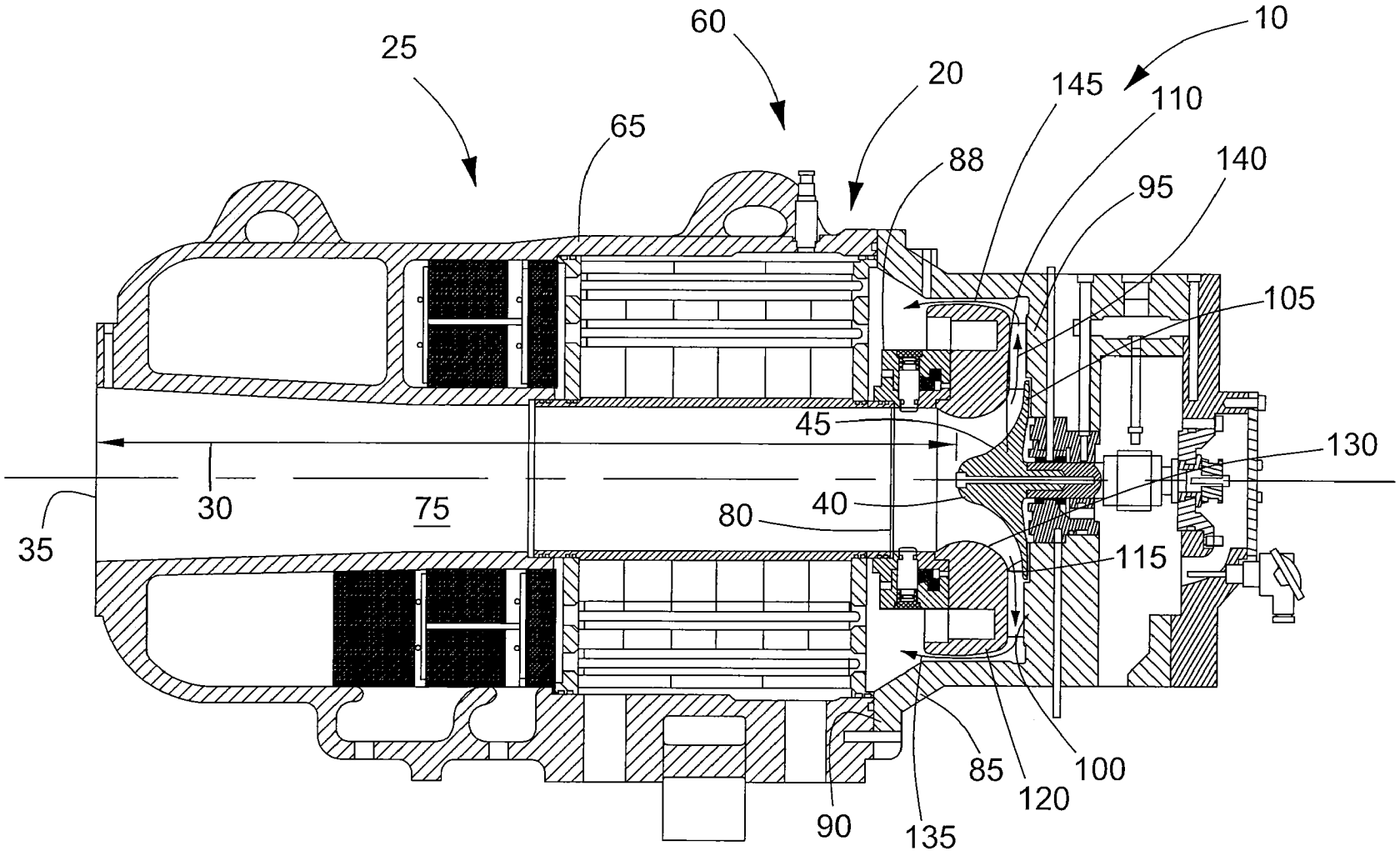
FIG. 1 is a sectional view through the centerline of a compression stage of a centrifugal gas compressor embodying the invention.
Figure 2:
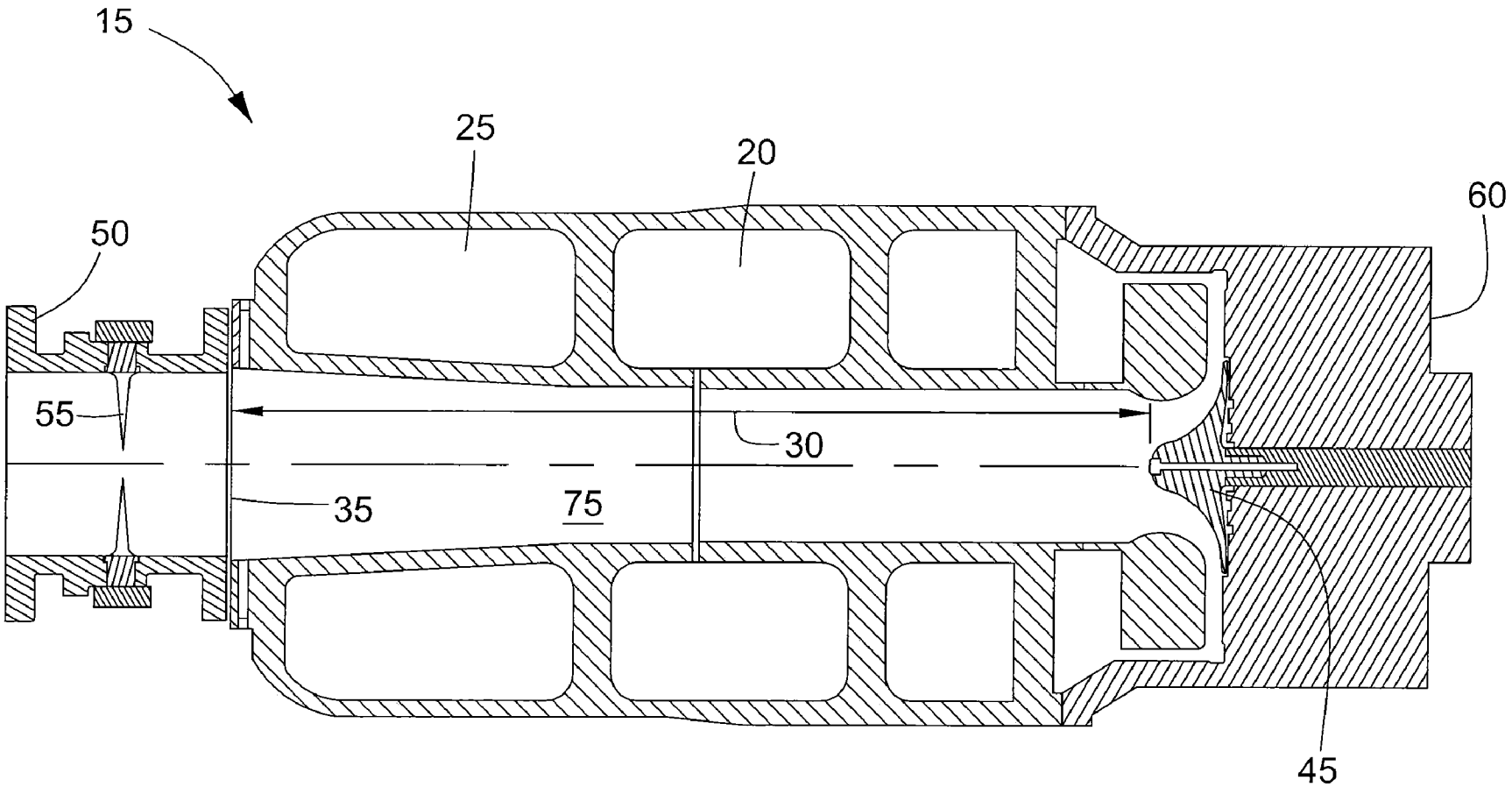
FIG. 2 (Prior Art)
FIG. 2 is a sectional view through the centerline of a prior art compression stage of a prior art centrifugal gas compressor.

FIGS. 1 and 2 illustrate centrifugal compressors 10, 15 or centrifugal compressor stages that include in-line intercooling systems 20 and moisture separators 25. Specifically, FIG. 1 illustrates a compressor or compressor stage 10 embodying the present invention, while FIG. 2 illustrates a prior art compressor or compressor stage 15. When the main design requirement of an intercooled centrifugal compressor is compactness, the most effective and economical approach is to design the compressor intercooling system 20 in-line with the compressor or compression stage 10, 15 as shown in FIGS. 1 and 2. Consequently, to accommodate the presence of the intercooling system 20 and the moisture separation system 25, a distance 30 develops between an inlet 35 of the compressor or compressor stage 10, 15 and an intake or inducer 40 of an impeller 45.

It should be noted that FIGS. 1 and 2 are referred to herein as illustrating a compressor or a compressor stage. Thus, the components illustrated in FIGS. 1 and 2 could be arranged as a stand-alone single-stage compressor or could be arranged in series and/or in parallel to define a multi-stage compressor. As such, the terms compressor and compressor stage may be used interchangeably herein.

Before proceeding with the discussion of the construction illustrated in FIGS. 1 and 3-13, some discussion of compressor operation is necessary. The compression cycle in dynamic compressors, and particularly centrifugal compressors, is based on the transfer of kinetic energy from rotating blades to a gas. The rotating blades impart kinetic energy to the fluid by changing its momentum and velocity. The gas momentum is then converted into pressure energy by decreasing the velocity of the gas in stationary diffusers and downstream collecting systems. The performance of a multistage centrifugal compressor depends on the conditions of the gas at the inlet of each compression stage and the operating speed of the compressor stages. In dynamic compression there is an interdependent relationship between capacity and compression ratio. Accordingly, a change in gas capacity, in centrifugal compressors, is generally accompanied by a change in the compression ratio. Also, a change in the temperature of the gas at the intake of a centrifugal compressor yields the same effects, in terms of volumetric flow and discharge pressure, as does the opening and closing of an inlet throttling device.

The function of a compressor is to supply to a receiving system or process, a required amount of gas at a certain rate and at a pre-determined discharge pressure. The rate at which the compressed gas is utilized by the receiving system or process at least partially determines the pressure at which the gas is supplied. Accordingly, as the demand for gas decreases, the pressure in the receiving system increases. In response, preferred compressor controls operate to decrease the amount of gas being compressed, while still maintaining the predetermined operating pressure (discharge pressure) to the receiving system or process.

One of the approaches to control the output of the centrifugal compressor 15 in response to the demand of the process is to alter the pressure at the inlet of the first compression stage impeller 45. To enhance the performance of a multistage centrifugal compressor, the same approach can also be applied to any intermediate stages of compression. One method to control the capacity of a centrifugal compressor is to utilize a throttling device 50 (e.g., an inlet valve) that produces a variable pressure drop. As the valve closes, a greater pressure drop develops, thus requiring the compressor 15 to generate a greater pressure ratio to maintain the discharge pressure at the prescribed operating value of the receiving process. Accordingly, throttling the inlet (i.e., closing the valve) reduces the volumetric capacity of the compressor 15. The regulation approach that solely utilizes an inlet throttling device 50 is feasible up to the maximum stable pressure of the compressor. Beyond this point, a blow-off valve (not shown) on the discharge section of the compressor 15 may be required to relieve the excess flow to maintain the required discharge pressure in the process without inducing unstable operation of the compressor 15 near the maximum achievable discharge pressure.

One prior art throttling device (not shown) includes a single disc which rotates about an axis perpendicular to the axis of the compressor's inlet flow. This type of throttling device is similar to a butterfly valve. A valve encompassing a single rotating disc is effective in inducing the required pressure drop. However, the disc produces an un-coordinated turbulent gas flow pattern that negatively affects the aerodynamic performance of the rotating impeller 45, especially when the valve is only a few pipe diameter lengths away from the impeller intake or inducer 40.

A more efficient design for a throttling device 50 includes multiple rotating vanes 55 as shown in FIG. 2. The throttling device 50 includes multiple vanes 55 and is generally referred to as an inlet guide vane throttling device or IGV 50. The flow leaving the inlet guide vane has a more coordinated velocity pattern than in the case of the single-disc throttling valve, thus reducing the amount of un-recoverable energy inherent in the throttling process. One of the additional benefits of the inlet guide vane 50, especially in the transition region between the fully closed and the fully open position of the vanes, is that a rotational momentum (swirl) is imparted to the stream of gas leaving the inlet guide vane device 50. Moreover, a proper sense of rotation of the vanes 55 also improves the approach of the flow to the impeller inducer 40, thus further enhancing the effectiveness and efficiency of compressor flow regulation. The vanes 55 could also be over-rotated past the fully open position with the effect of actually increasing the pumping capacity of a dynamic compressor 15.

In some constructions of the IGV 50 of FIG. 2, a special aerodynamic profile of the vanes 55 is employed to sustain the pre-rotation of the gas up to the intake of the impeller 45. The cross-section profile of such vanes 55 is a function of the compressor flow characteristics. Each vane 55 must be precisely cast and then properly machined to accommodate the mechanical requirements of the inlet guide vane assembly 50. However, the use of such a profile greatly increases the cost and complexity of the IGV device 50. Additionally, the vanes 55 are susceptible to undesirable flow characteristics, such as stall, and are optimized for one particular operating point. The optimization may result in significantly degraded operation when the compressor 15 is operated off of the design point.

With reference to FIGS. 1 and 2, the distance 30 is typically not sufficient to allow for a straightening of the flow velocity pattern, in the case of the application of a single-disc inlet throttling valve. Therefore, the adverse effects of the uncoordinated flow regime caused by the presence of the valve still affect the aerodynamic performance of the downstream impeller 45. On the other hand, the distance 30 is too long for efficient operation of the IGV 50 of FIG. 2 as the distance 30 causes a significant loss in flow rotational momentum.

Thus, the configuration of a centrifugal compressor 15 with intercoolers 20 in-line with the compression stages has, in fact, hindered the optimal application of the inlet guide vane device 50, since the device 50 had to be positioned too far from the impeller intake 40 so as to be utilized at its full potential.

FIGS. 1 and 3-13 illustrate aspects of a compressor 10 that solves many of the problems associated with prior art constructions including that shown in FIG. 2. Before proceeding, it should be understood that while FIGS. 1 and 3-13 are described as they relate to a compressor, one of ordinary skill in the art will realize that FIGS. 1 and 3-13 could be applied to one or more stages of a multi-stage compressor. As such, the invention should not be limited to single stage compressors, nor should it be limited to multi-stage compressors.

As illustrated in FIG. 1, the compressor 10 includes a compressor housing 60 that includes a first housing 65 that at least partially supports the intercooler 20 and a moisture separator 25. Virtually any intercooler 20 or moisture separator 25 can be employed so long as it can be substantially arranged in the space provided as illustrated in FIG. 1. The first housing 65 also defines a portion of an impeller intake channel 75 that provides for the flow of gas from the compressor head inlet 35 to a first housing outlet 80 near the inducer 40.

The compressor housing 60 also includes a second or diffuser housing 85 that attaches to the first housing 65 and at least partially supports an inlet guide vane and diffuser assembly 88 and the impeller 45. Thus, the compressor housing 60 includes a first end 90 that defines the inlet 35 and a second end 95 opposite the first end 90. An impeller portion 100 is defined by the compressor housing 60 adjacent the second end 100 and is positioned to allow for the positioning of the impeller 45 adjacent thereto.

The diffuser housing 85 attaches to the first housing 65 such that the impeller 45 and the inlet guide vane and diffuser assembly 88 are positioned adjacent the first housing outlet 80. This position allows the flow of gas that exits the first housing to pass at least part way through the inlet guide vane and diffuser assembly 88 before entering the impeller 45. In addition, this position allows the inlet guide vane and diffuser assembly 88 and the diffuser housing 85 to cooperate to define a diffuser.

The impeller 45 is rotatably coupled to a prime mover (not shown) such as an electric motor or engine that provides rotational power to the impeller 45. The impeller 45 includes a disk 105 that supports a plurality of blades 110. The blades define the inducer portion 40 and an exducer portion 115. The inducer portion 40 is positioned at the center of the impeller 45 and operates to draw in fluid to be compressed. As the fluid flows through the blades 110, its velocity is increased and its direction is changed such that it exits in a substantially radial direction through the exducer portion 115.

Figure 6:
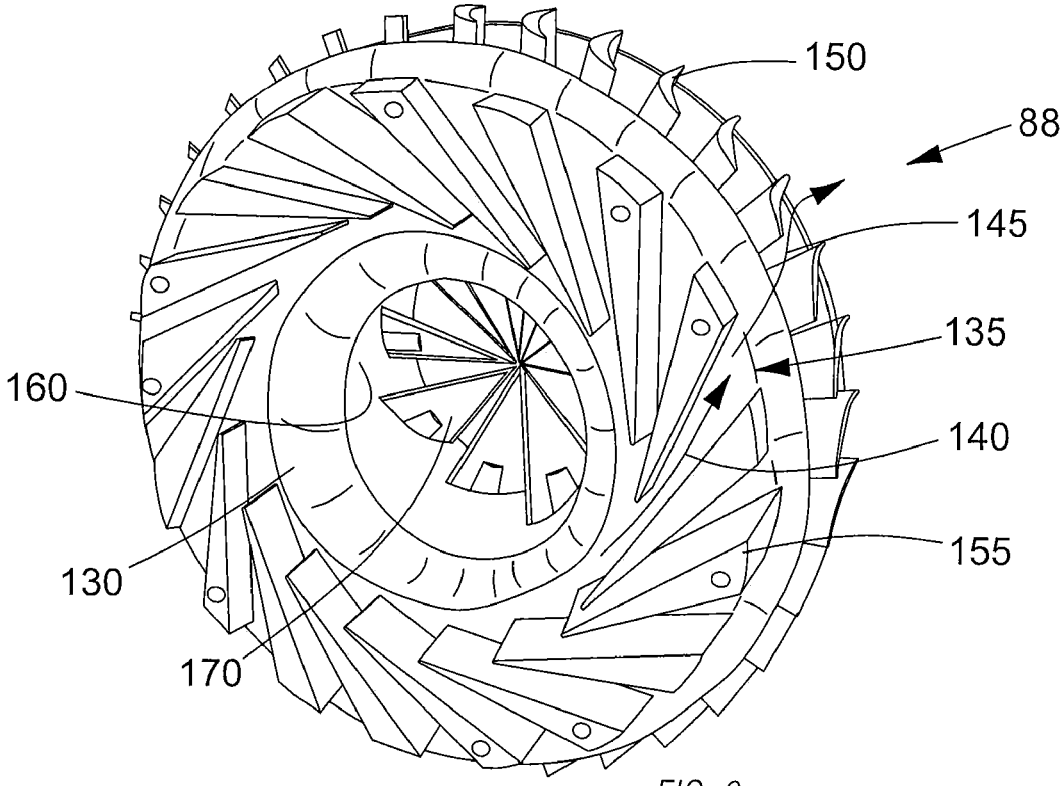
FIG. 6 is a perspective view of a portion of the movable inlet guide vane device of FIG. 3 including a diffuser.
Figure 5:
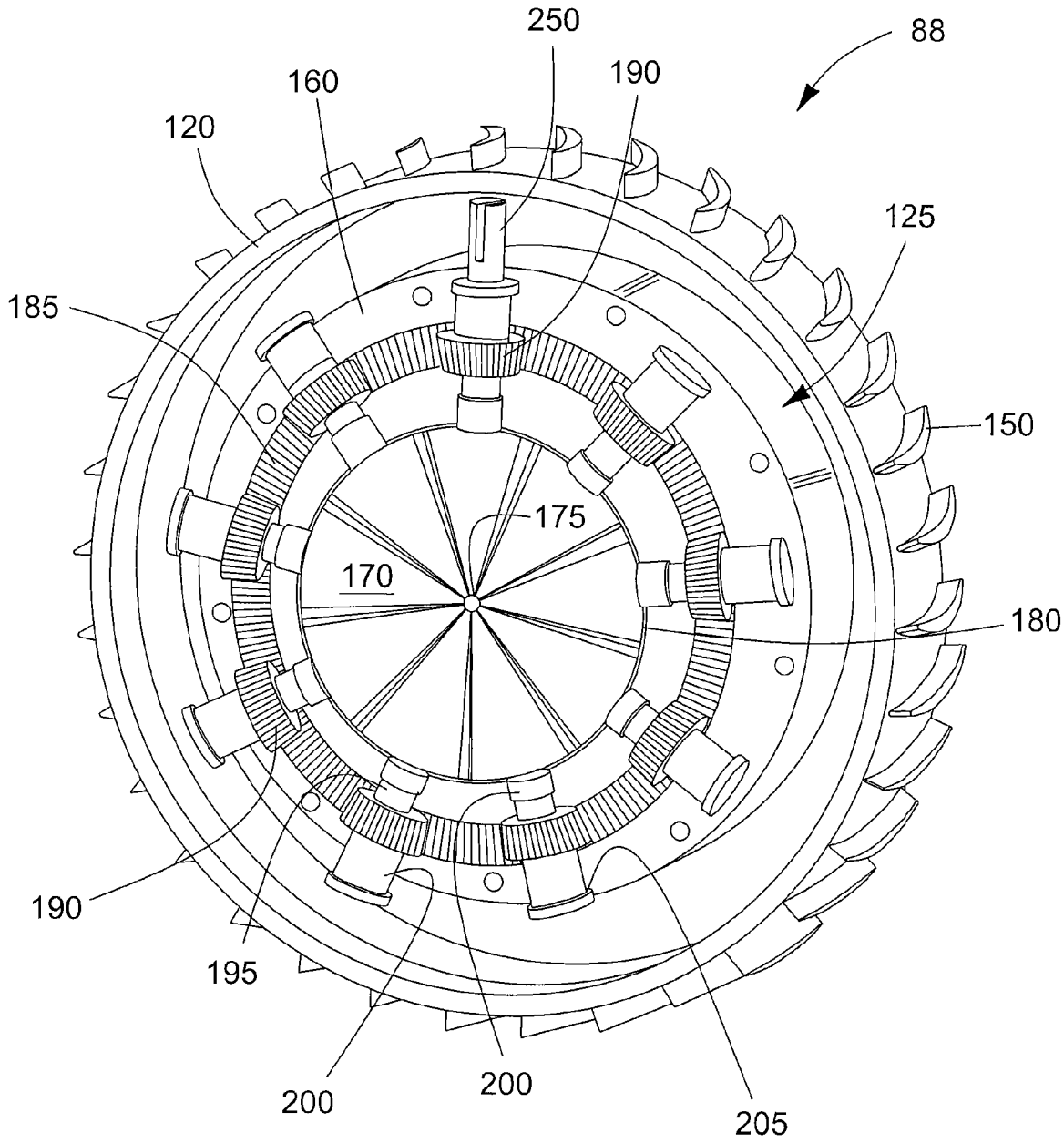
FIG. 5 is a perspective view of a portion of the movable inlet guide vane device of FIG. 3.
Figure 7:
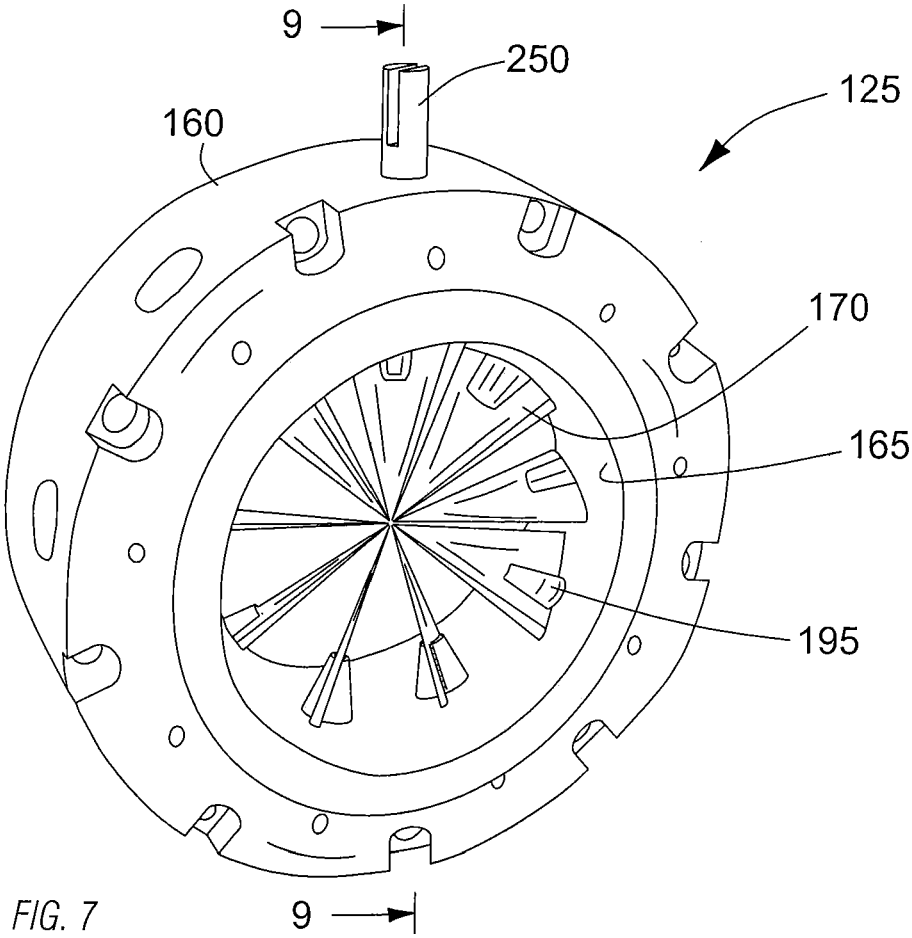
FIG. 7 is a perspective view of the movable inlet guide vane device of FIG. 3 in an open position.
Figure 8:
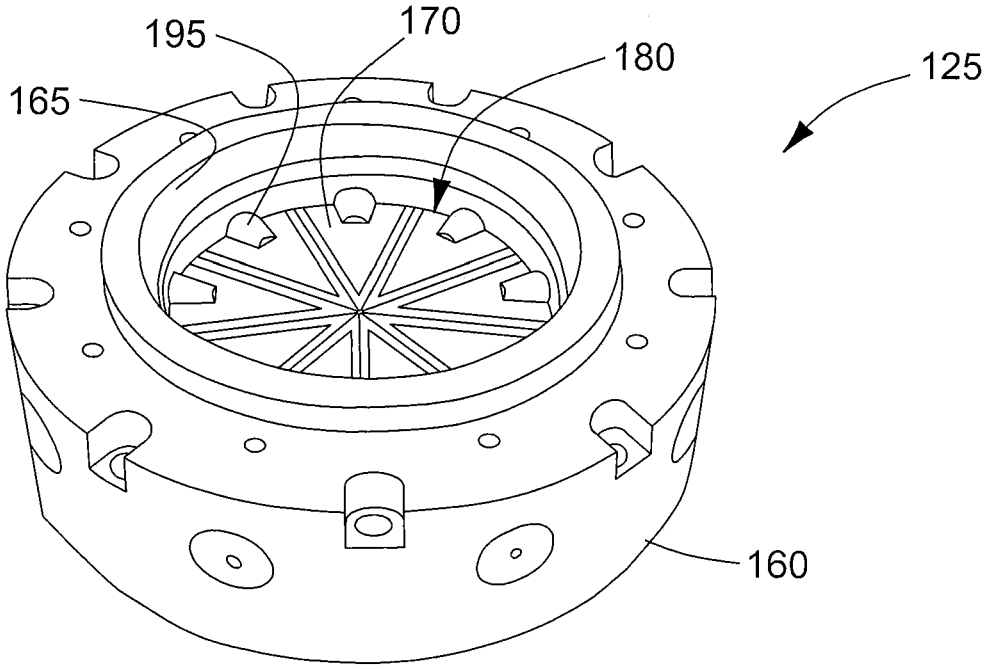
FIG. 8 is a perspective view of the movable inlet guide vane device of FIG. 3 in a closed position.

The inlet guide vane and diffuser assembly 88 includes a diffuser ring 120 and an inlet guide vane assembly (IGV) 125 attached to the diffuser ring 120. The diffuser ring 120 defines an intake ring contour 130, best illustrated in FIGS. 1 and 6 that cooperates with the impeller 45 to facilitate efficient flow between the two components. An exterior of the diffuser ring 120 cooperates with the diffuser housing 85 to at least partially define a diffuser flow path 135 that includes a radial flow portion 140 and an axial flow portion 145. In some constructions, a series of axial guide vanes or fins 150, shown in FIG. 5 extend substantially radially from or are formed as part of the exterior surface to guide flow in the axial flow portion 145 of the diffuser flow path 135. As illustrated in FIGS. 5 and 6, these axial guide vanes 150 are preferably aerodynamically-shaped, with other shapes also functioning as desired. In some constructions, diffuser radial vanes 155 are also formed as part of or extend from the diffuser ring 120. The diffuser radial vanes 155 extend axially from the exterior surface of the diffuser ring 120 to guide flow exiting the impeller 45 in a radial direction through the radial flow portion 140 of the diffuser flow path 135. Both the radial vanes 155 and axial vanes 150 are arranged to define expanding flow paths that reduce the flow velocity of the fluid as it flows through the vanes.

Figure 3:
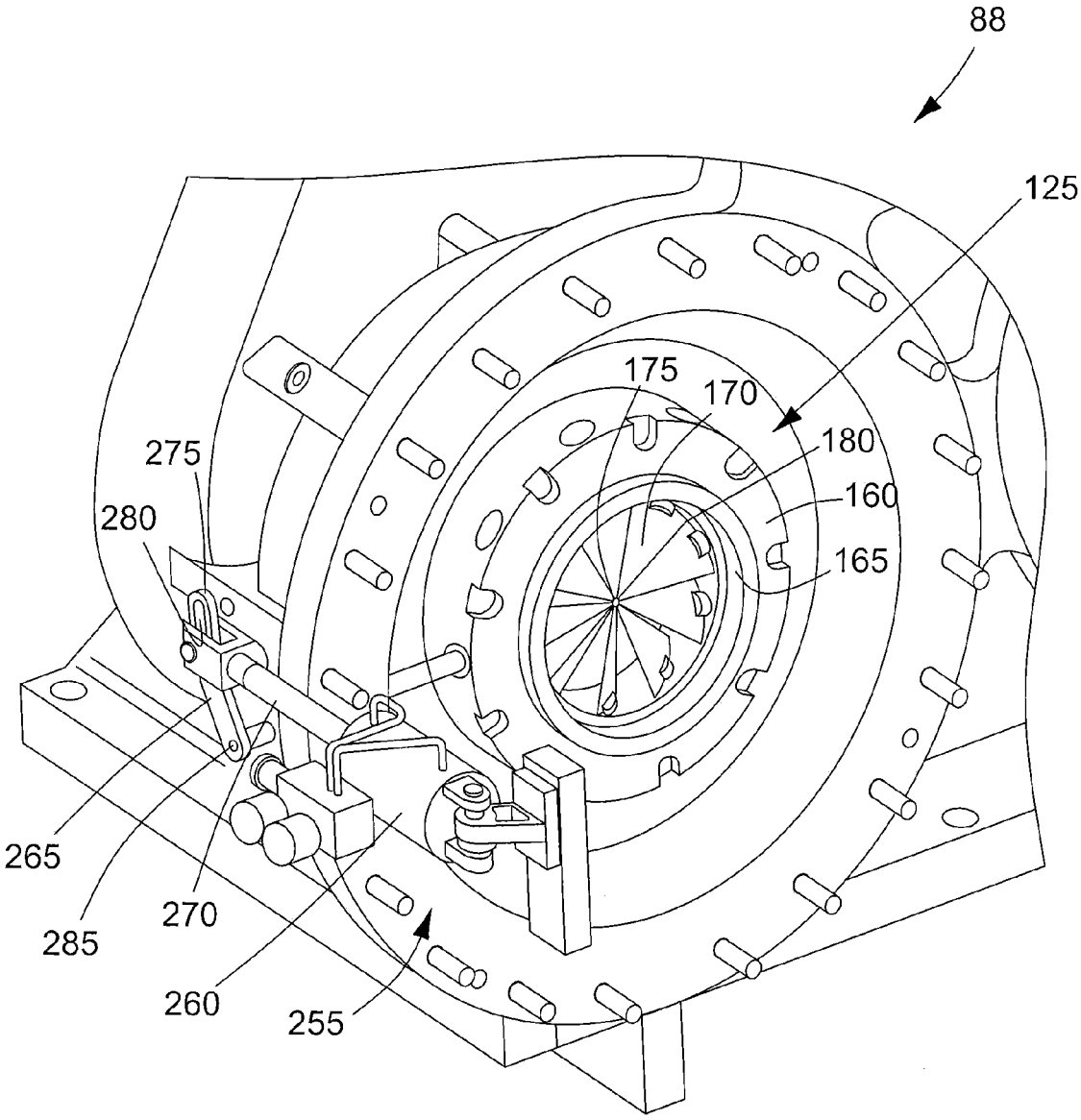
FIG. 3 is a perspective view of a portion of the compression stage of FIG. 1 including a movable inlet guide vane device.

The inlet guide vane assembly (IGV) 125, illustrated in FIGS. 3 and 5, includes a ring 160 that defines an aperture 165 that allows for the passage of gas from the first housing 65 to the diffuser ring 120 and the impeller 45. In preferred constructions, the aperture 165 is substantially centrally located with other locations being possible. A plurality of flat-plate vanes 170 are positioned within the aperture 165 and are rotatable about individual substantially radial axes between an open position and a closed position. When positioned in the closed position, the flat-plate vanes 170 cooperate to define minimum flow openings, near the center 175 and around the exterior 180 of the vanes 170, that allow for some flow past the flat-plate vanes 170 even when in the closed position.

Figure 9:
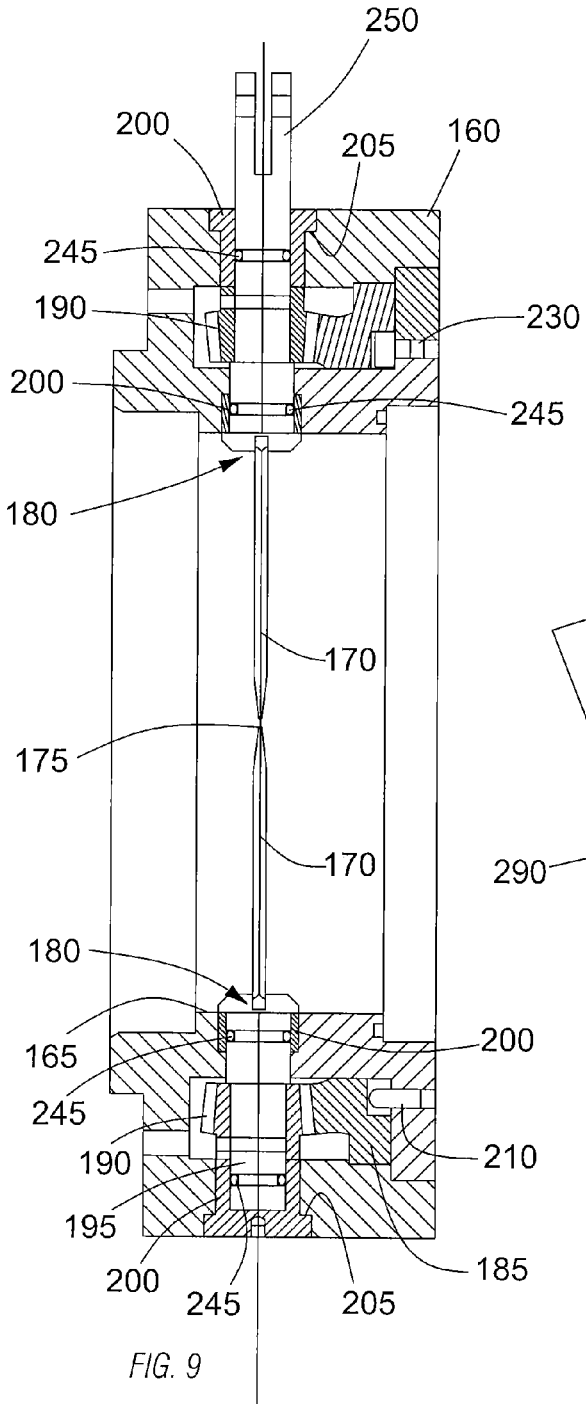
FIG. 9 is a section view of the movable inlet guide vane device of FIG. 7 taken along line 9-9 of FIG. 7.

With reference to FIG. 5, the inlet guide vane assembly 125 also includes a ring gear 185, a plurality of vane gears 190, a plurality of vane shafts 195, and a plurality of shaft bearings 200. The shaft bearings 200 are coupled to the ring 160 and fixedly supported with respect to the ring 160. Each of the plurality of vane shafts 195 is supported for rotation by two of the bearings 200. The bearings 200 are arranged such that each shaft 195 rotates about an axis that extends radially through the center of the ring 160. As illustrated in FIG. 9, preferred constructions include self-lubricated journal bearings 200 that support the shafts 195 and allow for rotation about the respective axis. Of course other types of bearings (e.g., roller bearings, ball bearings, needle bearings, bushings, etc.) could be employed if desired.

One of the plurality of vane gears 190 is supported by each of the vane shafts 195 such that rotation of the gear 190 produces a corresponding rotation of the shaft 195 to which it is attached. The gears 190 are positioned such that each one engages the ring gear 185. Thus, rotation of the ring gear 185 produces a corresponding rotation of each of the vane gears 190 and each of the shafts 195.

In a preferred construction, a bevel ring gear 185 and bevel vane gears 190 are employed. However, spur gears or other types of gears could also be employed if desired. The bevel-gear system is preferred because of the requirement to transfer the rotational motion from a first direction to a second direction that is substantially perpendicular to the first direction. Specifically, the direction of rotation of the vane gears 190 and vane shafts 195 are perpendicular to the direction of rotation of the gear ring 185. The bevel-gear system is also self-aligning, so long as all of the gears 185, 190 remain in reciprocal contact during actuation.

The use of bevel gears 185, 190 results in a net thrust force on each of the vane shafts 195 as well as on the ring gear 185. One of the bearings 200 that supports each vane shaft 195 includes a thrust feature 205, shown in FIG. 9, that engages the end of the shaft 195 to carry the thrust loads. Of course, other constructions could include a third bearing that supports the thrust load or could employ a different arrangement than that illustrated in FIG. 9.

Figure 14:
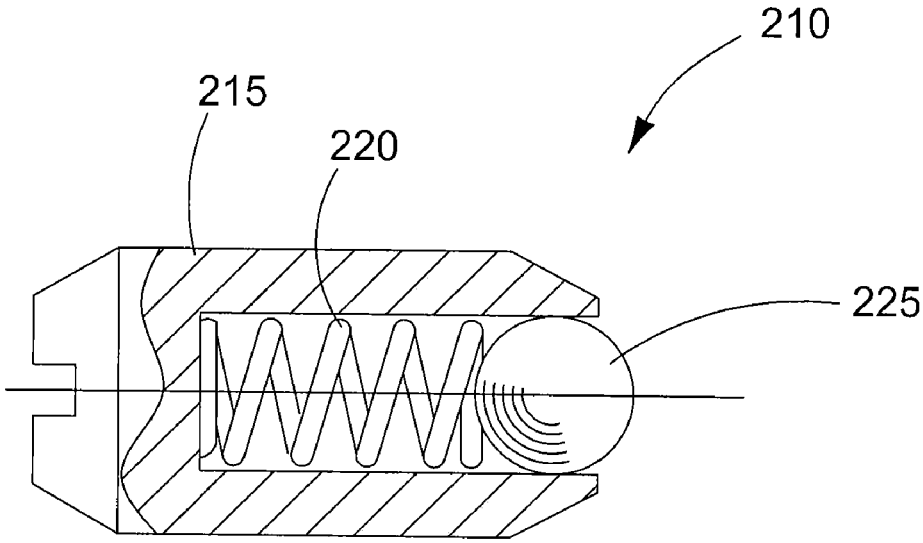
FIG. 14 is a section view of a thrust ball assembly that supports a bevel ring gear for rotation

The ring gear 185 is supported by a plurality of thrust ball assemblies 210 as illustrated in FIGS. 9 and 14. As illustrated in FIG. 14, each thrust ball assembly 210 includes a body 215, a biasing member 220, and a ball 225. The body 215 is engageable with the ring 160 such that the ball 225 is in contact with the ring gear 185. The body 215 may include threads that engage an aperture in the ring 160 or other engagement means. The biasing member 220, such as a compression spring, and the ball 225 are trapped within the body 215 such that a portion of the ball 225 extends beyond the body 215. The ball 225 engages the ring gear 185 and supports the ring gear 185 for rotation about its axis. Additionally, any thrust load applied to the ring gear 185 is accommodated by the biasing member 220.

It should be noted that the axial preloading of the ring gear 185 is preferably evenly distributed. However, manufacturing tolerances make such an alignment difficult. To improve the alignment, the axial position of the thrust ball assemblies 210 can be adjusted during the assembly of the inlet guide vane 125 to improve the alignment. Additionally, since each thrust ball assembly 210 is equipped with a biased ball 225 as shown in FIG. 14, it follows that the axial misalignment of the bevel ring gear 185 during valve actuation can be accommodated.

A plurality of alignment bolts 230 are coupled to the ring 160 to further aid in properly positioning and supporting the ring gear 185. Each alignment bolt 230, illustrated in FIG. 13 includes an engagement end 235 and a body fit portion 240. The engagement end 235 engages the ring 160 to fixedly attach the alignment bolts 230 to the ring 160 such that the body fit portion 240 extends outward to a position that allows for its engagement with the ring gear 185. Thus, the alignment bolts 230 aid in positioning the ring gear 185 in the proper position and support the ring gear 185 in that position such that it is rotatable about its axis. In some constructions, the body portion 240 includes a bearing (e.g., roller bearing, needle bearing, ball bearing, journal bearing, and the like) that aids in supporting the ring gear 185 for rotation.

Figure 13:
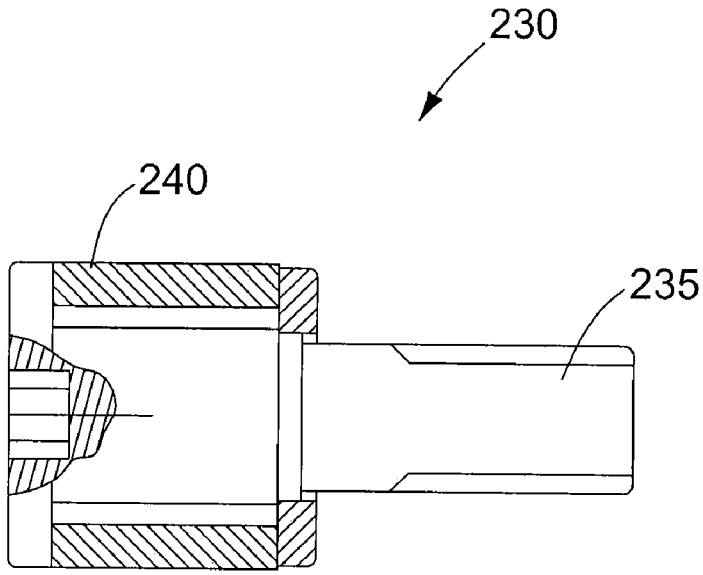
FIG. 13 is a section view of an alignment bolt.

The alignment bolts 230 of FIG. 13 are also useful during the assembly of the inlet guide vane assembly 125 since it provides an accurate location of the ring gear 185 with respect to the gears 190 assembled on the vane shafts 195.

With reference to FIG. 9, the inlet guide vane assembly 125 also includes two o-rings 245 assembled on each vane shaft 195 to provide a proper seal between the high-pressure side (adjacent the diffuser outlet) and the low-pressure side (adjacent the aperture 165) of the inlet guide vane assembly 125. Other sealing arrangements and mechanisms could be employed in place of, or in conjunction with the o-rings 245 if desired.

Figure 4:
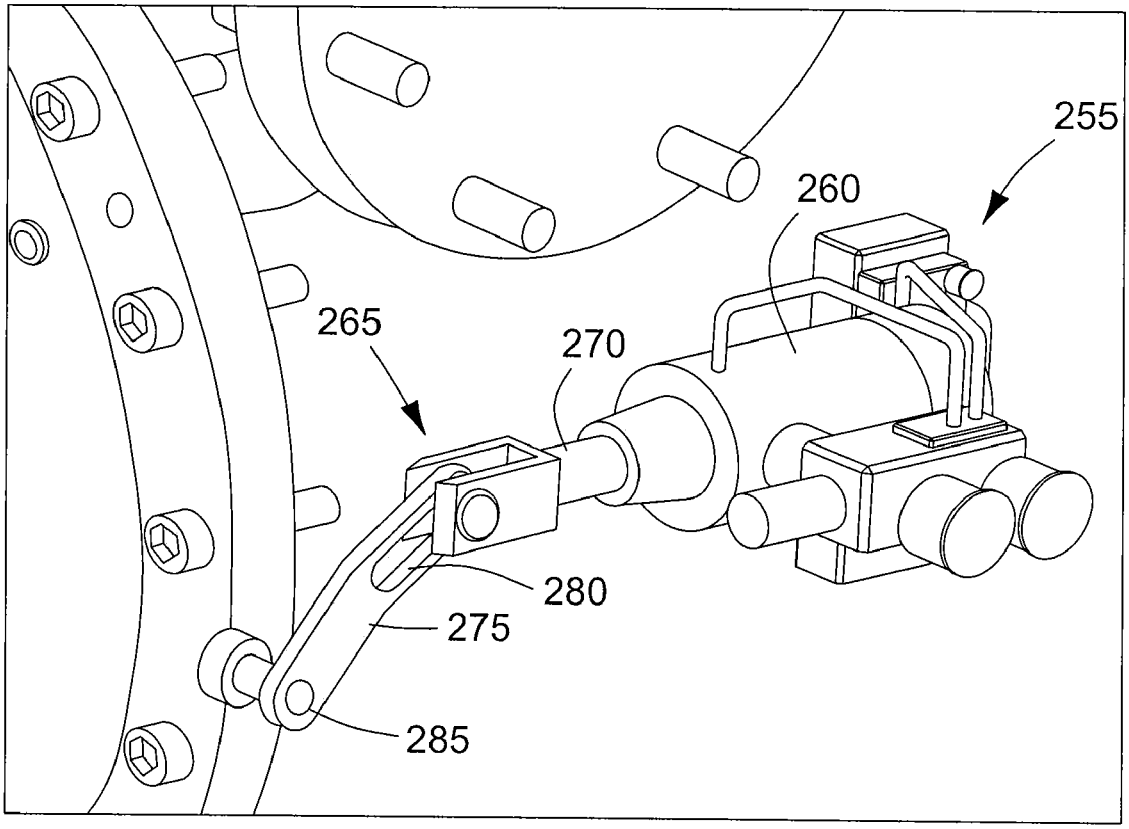
FIG. 4 is a perspective view of a portion of the compression stage of FIG. 1 including an actuator arrangement coupled to the movable inlet guide vane device of FIG. 3.

One of the vane shafts 195 is an extended shaft 250 that extends radially outward beyond the other shafts 195 and facilitates connection of the flat-plate vanes 170 to an actuator assembly 255. As illustrated in FIGS. 3 and 4, the actuator assembly 255 includes an actuator 260 and a linkage 265 that interconnects the actuator 260 and the extended shaft 250. In the illustrated construction, a linear hydraulic actuator 260 is employed. The actuator 260 includes a ram 270 that extends from one end of the actuator 260 and moves a predefined distance in a substantially linear manner in response to a controlled flow of a hydraulic fluid. Other suitable actuators 260 include both rotary and linear air powered or pneumatic actuators, both rotary and linear electric motors, as well as other similar actuators.

The linkage 265 includes a link arm 275 that includes a slot 280 at a first end and an aperture 285 at a second end. The aperture 285 engages the extended shaft 250 such that the link arm 275 and the shaft 250 rotate in unison. The slot 280 engages the ram 270 such that the linear motion of the ram 270 is translated into rotary motion at the extended shaft 250.

Figure 10:
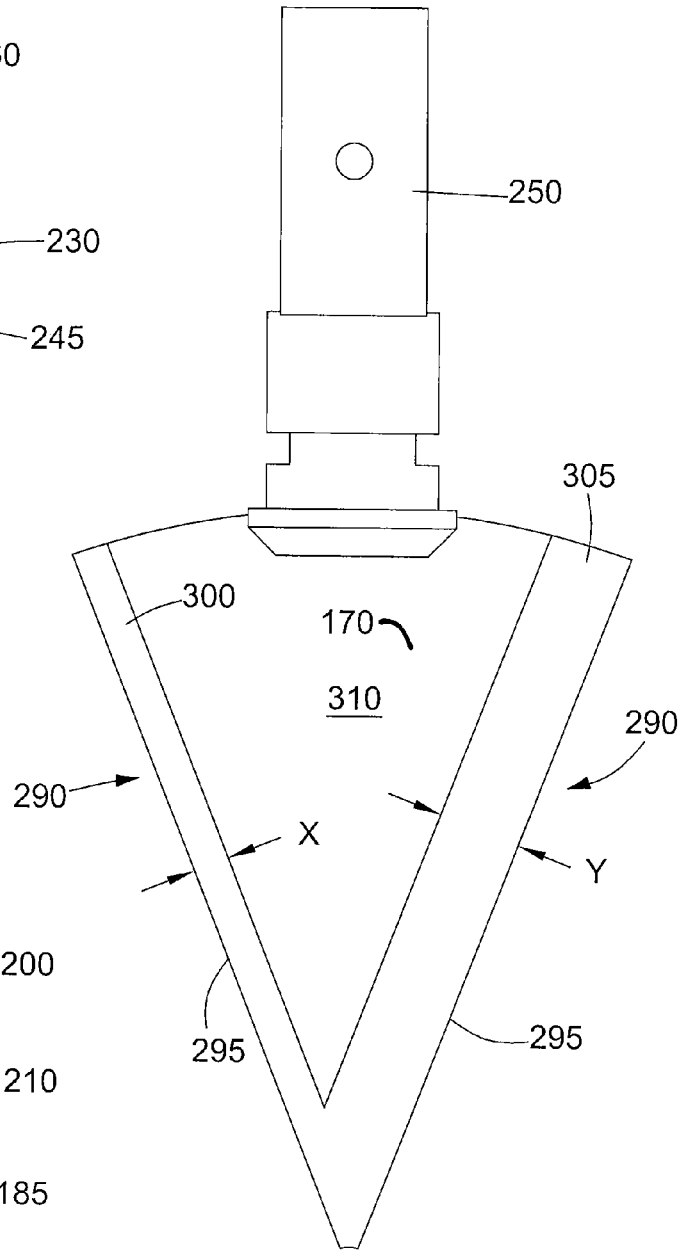
FIG. 10 is a front view of an inlet guide vane of the inlet guide vane device of FIG. 3.
Figure 11:
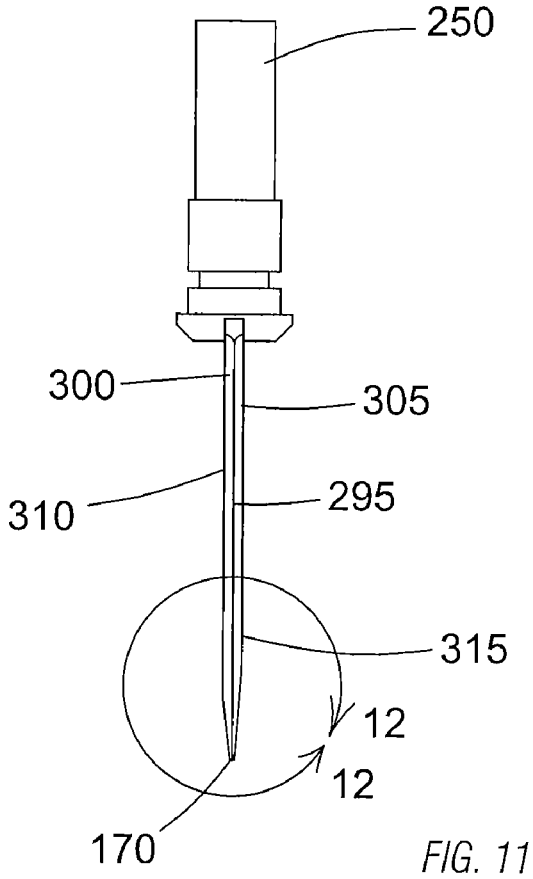
FIG. 11 is a top view of the inlet guide vane of FIG. 10.
Figure 12:
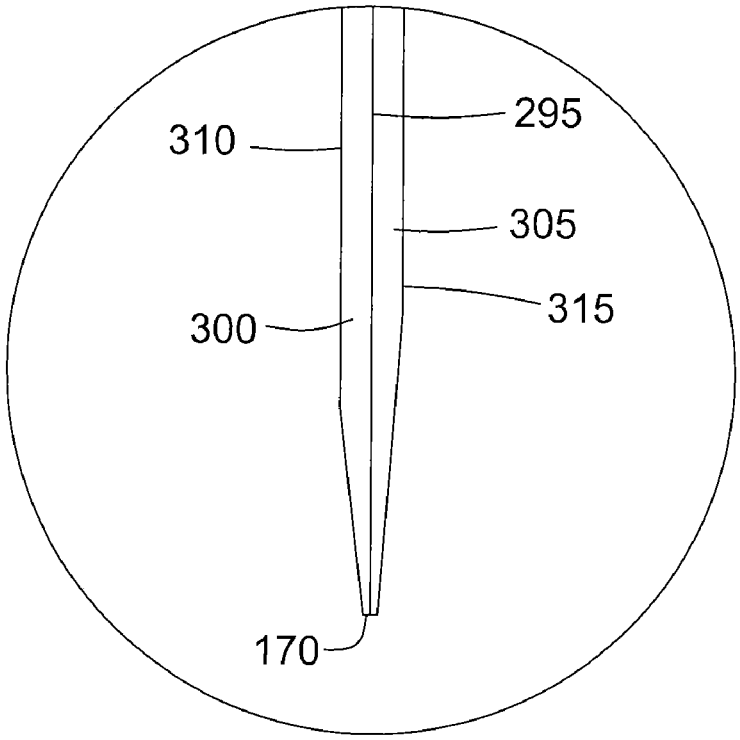
FIG. 12 is an enlarged view of a portion of the inlet guide vane of FIG. 10 taken along curve 12-12 of FIG. 11.

Turning to FIGS. 10-12, each flat-plate vane 170 is substantially triangular and includes two substantially linear sides 290 that narrow to a knife edge 295. The knife edges 295 allow adjacent flat-plate vanes 170 to contact one another when in the closed position to better close the aperture 165. In preferred constructions, the two sides 290 have differing geometry on either side of the vane 170 (best illustrated in FIG. 12) to further enhance the closure of the aperture 165 when the vanes 170 are moved to the closed position. Specifically, each side 290 includes an upstream bevel 300 and a downstream bevel 305 that are differently sized. Generally, the upstream bevel 300 on a first side of the vane 170 is similarly sized to the downstream bevel 305 on a second side of the vane 170. Similarly the downstream bevel 305 on the first side is similarly sized to the upstream bevel 300 on the second side. In one construction, the larger of the two bevels 300, 305 is about 5 mm wide (labeled "Y" in FIG. 10), while the smaller of the bevels 300, 305 is about 3 mm wide (labeled "X" in FIG. 10). Of course other arrangements and other sides 290 could be employed if desired.

With continued reference to FIGS. 10-12, each triangular vane 170 includes two substantially planar surfaces 310, 315 that are opposite and parallel to one another. While more aerodynamic shapes could be employed, the use of flat plate vanes 170 greatly reduces the cost of the vanes 170 while having a minimal effect on performance.

Each flat-plate vane 170 attaches to the corresponding vane shaft 195 that extends radially through the ring 160 to attach the vanes 170 to the ring 160. The vane shaft 195 attaches near the base of the triangular vanes 170 such that one vertex extends inward toward the center of the aperture 165 when the vanes 170 are assembled into the ring 160.

The arrangement illustrated herein solves the problem of positioning the inlet guide vane assembly 125 too far from the impeller inducer 40 by integrating the inlet guide vane assembly 125 with the compressor stage diffuser assembly, as illustrated in FIG. 1. This allows for the proper connection of the intake channel 75 to the impeller inlet 40 without additional modification to the remaining components of the stage assembly.

In operation, the inlet guide vane assembly 125 is bolted or otherwise coupled to the diffuser ring 120, as shown in FIG. 1. This assembly 88 is in turn coupled to the diffuser housing 85 such that it is positioned adjacent the impeller 45. As the impeller 45 begins to rotate, gas to be compressed is drawn down the impeller intake channel 75. The gas passes through the inlet guide vane assembly 125 and into the impeller 45. The impeller 45 increases the velocity of the gas and directs the gas to the diffuser flow path 135. The impeller 45 and the diffuser ring 120 cooperate to define a plurality of semi-closed flow paths through which the gas passes as it flows through the impeller 45.

As the gas flows through the diffuser flow path 135, the flow velocity is reduced with a corresponding increase in pressure and temperature. The gas then flows through the cooler 20 and the moisture separator 25 before being directed to a point of use or to another compressor stage Each compressor or compression stage 10 is controlled by one or more control systems that monitor various parameters of the system (e.g., stage inlet pressure, stage outlet pressure, inlet temperature, outlet temperature, flow velocity, volumetric flow rate, etc.) and use this data to adjust the inlet guide vanes 170 as required by the particular system. To adjust the inlet guide vanes 170, a signal that corresponds to the desired actuator position is sent to the actuator 260. For example, a signal may indicate that the actuator 260 should be in its 50 percent travel position. The actuator 260 moves to the position corresponding to the signal, thus changing the position of the ram 270. A feedback mechanism (e.g., position sensor, LVDT, RVDT, etc.) may be employed to assure that the ram 270 moves to the desired position. As the ram 270 moves, the linear motion is transferred through the linkage 265 to the extended vane shaft 250. As the extended vane shaft 250 rotates, its vane gear 190, which is engaged with the ring gear 185, rotates, thereby rotating the ring gear 185. As discussed, the thrust ball assemblies 210 and alignment bolts 230 cooperate to support the ring gear 185 for rotation as well as support any thrust load that may be produced during the rotation.

The rotation of the ring gear 185 produces a corresponding rotation of the remaining vane gears 190, which in turn rotates the vanes 170 attached to the individual vane shafts 195. Thus, each of the plurality of vanes 170 rotates simultaneously. As the flow passes through the vanes 170, a swirl may be induced. The swirl does not diminish as it does with prior art arrangements as the guide vanes 170 are positioned immediately adjacent the impeller inlet 40. Thus, the positive flow effects of the swirl are not lost when employing the device disclosed herein.

During some operating conditions, it is desirable to completely close the inlet guide vanes 170. However, it is particularly important to insure that a minimum flow of gas pass through the inlet guide vane assembly 125 when the vanes 170 are in the fully closed position. The minimum flow is needed to assure adequate cooling of the compressor stage. As illustrated in FIGS. 3 and 5, a small flow area, including the aperture 175 is still provided with the inlet guide vanes 170 in the fully closed position. Additionally, the annular opening 180 between the ring 160 and the vanes 170 is also provided to assure adequate flow even when the vanes 170 are closed.

Only a limited amount of gas flow will pass through the inlet guide vane assembly 125 in the fully closed position, thus significantly reducing the power consumption of the compressor during unloaded operation. To achieve the intended objective to insure that only a minimum amount of gas passes through the inlet guide vane assembly 125 when the vanes 170 are in the fully closed position, the geometry of the vanes 170 is carefully developed, as shown in FIGS. 10-12. Visible in FIGS. 10-12 is the asymmetric bevel feature on the sides 290 of the vanes 170. The asymmetric bevel assures that adjacent vanes 170 can contact one another and fully close such that a partial seal is established between the beveled surfaces. Additionally, the tapered feature at the leading edge of each blade (i.e., the knife edge 295) facilitates the aerodynamic interaction between the blades 170 and the incoming gas flow.

In summary, the device illustrated herein allows for an inlet guide vane throttling assembly 125 to be positioned in the optimal proximity of the inducer 40 of the centrifugal impeller 45 in dynamic compressor designs with in-line intercoolers 20. The device 125 utilizes a bevel-gear system augmented by alignment and antifriction bearing features.

While the foregoing describes the invention as including an inlet guide vane assembly 125 that controls the capacity of centrifugal compressors having coolers 20 in-line with the compression stages, other applications may function with other types of compressors or other compressor arrangements.

The inlet guide vane throttling assembly 125 may be internally installed near the impeller 45 in centrifugal compressors with in-line intercoolers 20, may be an integral part of the compressor diffuser system, and may interface with the compressor intercooler system 20.

The construction and functionality of one inlet guide vane device 125 may include a vertically split housing or ring 160, a bevel-gear gear system externally operated by means of a linear actuator 260 connected to a cam or linkage mechanism 265, and a shaft assembly connected to a single vane 170, namely the driving vane, to which the external torque is applied. The rotational motion applied to the driving vane is then synchronously transmitted to other vanes by means of the bevel-gear system. The inlet guide vane assembly 125 also includes radial and thrust bearing features to align the bevel-gear system during assembly and to maintain proper gear functionality during the operation of the device and a number of synchronously operated flat-plate vanes 170 with special geometric features to allow for optimal sealing when the assembly 125 is in the fully closed position and aerodynamic interaction with the incoming fluid. The inlet guide vane assembly 125 also includes a system of self-lubricated journal bearings 200 and spacers supporting each vane 170 and a sealing system applied to each vane 170 and comprising two o-rings 245 properly seated in grooves machined on each vane shaft 195.

Thus, the invention provides, among other things, an adjustable guide vane assembly 125. The adjustable guide vane assembly 125 is positioned between the impeller 45 and an intercooler 20 and is formed as part of the compression stage diffuser.

What is claimed is:

1. A compressor assembly having a fluid inlet positioned to facilitate the passage of a fluid, the compressor assembly comprising:

a compressor housing defining a compressor inlet;

an impeller rotatably supported at least partially within the compressor housing, the impeller including an inducer portion;

a fluid treatment member disposed adjacent the compressor housing and between the compressor inlet and the inducer portion; and an inlet vane assembly disposed adjacent the impeller and spaced apart from the compressor inlet such that the inlet vane assembly is between the impeller and the fluid treatment member, the inlet vane assembly including a plurality of vanes, each of the vanes movable between a first closed position, a second fully open position, and a third over-rotated position to control the quantity of fluid and the sense of rotation of the fluid that passes to the impeller, wherein the fluid passes directly from the inlet vane assembly to the impeller and from the impeller to the fluid treatment member.

2. The compressor assembly of claim 1, wherein the fluid treatment member is one of a cooler and a moisture separator.

3. The compressor assembly of claim 1, wherein each vane includes a first substantially planar surface and a second substantially planar surface opposite and parallel to the first substantially planar surface.

4. The compressor assembly of claim 1, further comprising a plurality of vane gears, each coupled to one of the plurality of vanes, each vane gear rotatable to move the vane to which the vane gear is coupled.

5. The compressor assembly of claim 4, further comprising a ring gear coupled to each of the vane gears, the ring gear movable to move each of the vane gears simultaneously.

6. The compressor assembly of claim 5, wherein one of the vanes is coupled to a linear actuator, the linear actuator operable to rotate each of the plurality of vanes.

7. A compressor assembly having a fluid inlet positioned to facilitate the passage of a fluid, the compressor assembly comprising:

a compressor housing defining a compressor inlet;

an impeller supported at least partially within the compressor housing for rotation about an axis, the impeller including an inducer portion;

a fluid treatment member disposed adjacent the compressor housing and between the compressor inlet and the inducer portion, wherein the fluid treatment member is one of a cooler and a moisture separator;

an inlet vane assembly disposed along the axis between the impeller and the fluid treatment member and including a plurality of vanes, each of the vanes movable between a first position and a second position to control the quantity of fluid that passes to the impeller; and a second fluid treatment member disposed adjacent the compressor housing and between the compressor inlet and the inducer portion, the second fluid treatment member being the other of the cooler and the moisture separator, wherein each vane is substantially triangular and includes two substantially linear sides, and wherein each side includes an upstream bevel and a downstream bevel and wherein the upstream bevel and the downstream bevel are not equal in size.

8. A compressor assembly comprising:

a first stage including:

a first inlet;

a first impeller rotatable about a first axis that defines a first axial direction;

a first cooler, at least a portion of the first cooler disposed axially between the first impeller and the first inlet; and a first inlet vane assembly positioned adjacent the first impeller and spaced apart from the first inlet such that the first cooler is disposed between the first inlet and the first inlet vane assembly, the first inlet vane assembly movable between a first position and a second position; and a second stage including:

a second inlet;

a second impeller rotatable about a second axis that defines a second axial direction;

a second cooler, at least a portion of the second cooler disposed axially between the second impeller and the second inlet; and a second inlet vane assembly positioned adjacent the second impeller and spaced apart from the second inlet such that the second cooler is disposed between the second inlet and the second inlet vane assembly, the second inlet vane assembly movable between a first position and a second position, the second stage coupled to the first stage such that a flow of fluid enters the first inlet, flows through the first stage, and enters the second stage, wherein the first inlet vane assembly includes a plurality of vanes, the vanes movable between a first vane position and a second vane position, and wherein each vane is substantially triangular and includes two substantially linear sides, and wherein each side includes an upstream bevel and a downstream bevel and wherein the upstream bevel and the downstream bevel are not equal in size.

9. The compressor assembly of claim 8, wherein each vane includes a first substantially planar surface and a second substantially planar surface opposite and parallel to the first substantially planar surface.

10. The compressor assembly of claim 8, further comprising a plurality of vane gears, each coupled to one of the plurality of vanes, each vane gear rotatable to move the vane to which the vane gear is coupled.

11. The compressor assembly of claim 10, further comprising a ring gear coupled to each of the vane gears, the ring gear movable to move each of the vane gears simultaneously.

12. The compressor assembly of claim 11, wherein one of the vanes is coupled to a linear actuator, the linear actuator operable to rotate each of the plurality of vanes.

13. A compressor assembly comprising:

a compressor housing defining an inlet adjacent a first end and an impeller portion adjacent a second end;

a fluid treatment member at least partially supported by the compressor housing between the first end and the second end;

an inlet vane assembly positioned adjacent the second end such that the inlet vane assembly is disposed between the impeller portion and the fluid treatment member, the inlet vane assembly including a plurality of vanes arranged to define a flow area, each of the vanes movable between a first closed position, a second fully open position, and a third over-rotated position to vary the flow area, to control the quantity of fluid passing therethrough and to control the sense of rotation of the fluid passing therethrough; and an impeller rotatably supported adjacent the impeller portion and operable to draw a flow of fluid through the inlet vane assembly and the flow area and direct the flow of fluid to the fluid treatment member.

14. The compressor assembly of claim 13, wherein the fluid treatment member is one of a cooler and a moisture separator.

15. The compressor assembly of claim 13, wherein each vane is substantially triangular and includes two substantially linear sides.

16. The compressor assembly of claim 15, wherein each side includes an upstream bevel and a downstream bevel and wherein the upstream bevel and the downstream bevel are not equal in size.

17. The compressor assembly of claim 13, wherein each vane includes a first substantially planar surface and a second substantially planar surface opposite and parallel to the first substantially planar surface.

18. The compressor assembly of claim 13, further comprising a plurality of vane gears, each coupled to one of the plurality of vanes, each vane gear rotatable to move the vane to which the vane gear is coupled.

19. The compressor assembly of claim 18, further comprising a ring gear coupled to each of the vane gears, the ring gear movable to move each of the vane gears simultaneously.

20. The compressor assembly of claim 19, wherein one of the vanes is coupled to a linear actuator, the linear actuator operable to rotate each of the plurality of vanes.

21. A compressor assembly comprising:

a compressor housing defining an inlet adjacent a first end and an impeller portion adjacent a second end;

a fluid treatment member at least partially supported by the compressor housing, wherein the fluid treatment member is one of a cooler and a moisture separator;

an inlet vane assembly positioned adjacent the second end such that the inlet vane assembly is disposed between the impeller portion and the fluid treatment member, the inlet vane assembly including a plurality of vanes arranged to define a flow area, each of the vanes movable between a first closed position, a second fully open position, and a third over-rotated position to vary the flow area and the sense of rotation of the fluid passing therethrough;

an impeller rotatably supported adjacent the impeller portion and operable to draw a flow of fluid through the inlet and the flow area and direct the flow of fluid to the fluid treatment member; and a second fluid treatment member disposed adjacent the compressor housing and between the first end and the second end, the second fluid treatment member being the other of the cooler and the moisture separator.

* * * * *